US008469662B2

(12) United States Patent
Lebrun et al.

(10) Patent No.: US 8,469,662 B2
(45) Date of Patent: Jun. 25, 2013

(54) GUIDE VANE ARCHITECTURE

(75) Inventors: Rodolphe Lebrun, Namur (BE); Alain Derclaye, Couthuin (BE)

(73) Assignee: Techspace Aero S.A., Milmort (BE)

( * ) Notice: Subject to any disclaimer, the term of this patent is extended or adjusted under 35 U.S.C. 154(b) by 756 days.

(21) Appl. No.: 12/640,062

(22) Filed: Dec. 17, 2009

(65) Prior Publication Data

US 2010/0158685 A1 Jun. 24, 2010

(30) Foreign Application Priority Data

Dec. 22, 2008 (EP) ..... 08172599

(51) Int. Cl.
*F01D 9/04* (2006.01)

(52) U.S. Cl.
USPC ..... 415/209.4; 415/210.1

(58) Field of Classification Search
USPC ..... 415/191, 209.2, 209.3, 209.4, 210.1; 29/889.21
See application file for complete search history.

(56) References Cited

U.S. PATENT DOCUMENTS

| | | | | |
|---|---|---|---|---|
| 3,004,750 | A * | 10/1961 | Broders | 415/209.4 |
| 5,083,900 | A * | 1/1992 | Carletti et al. | 415/209.3 |
| 5,474,419 | A | 12/1995 | Reluzco et al. | |
| 5,584,654 | A | 12/1996 | Schaefer et al. | |
| 6,296,442 | B1 * | 10/2001 | Tran | 415/189 |
| 6,343,912 | B1 * | 2/2002 | Manteiga et al. | 415/138 |
| 6,371,725 | B1 * | 4/2002 | Manteiga et al. | 415/209.4 |
| 6,543,995 | B1 | 4/2003 | Honda et al. | |
| 6,969,239 | B2 * | 11/2005 | Grant et al. | 416/220 R |
| 2007/0147993 | A1 * | 6/2007 | Lhoest et al. | 415/191 |
| 2009/0317246 | A1 * | 12/2009 | Lutz et al. | 415/200 |
| 2010/0158685 | A1 * | 6/2010 | Lebrun et al. | 415/209.3 |
| 2011/0150643 | A1 * | 6/2011 | Wery et al. | 415/200 |

FOREIGN PATENT DOCUMENTS

| | | | |
|---|---|---|---|
| DE | 1476928 | A1 | 7/1969 |
| EP | 0953729 | A1 | 11/1999 |
| EP | 1167693 | A2 | 1/2002 |
| EP | 1433925 | A1 * | 6/2004 |
| EP | 1801357 | A1 | 6/2007 |
| EP | 1936121 | A1 | 6/2008 |
| WO | WO 2008/000014 | A2 | 1/2008 |
| WO | WO 2008000014 | A2 * | 1/2008 |

* cited by examiner

*Primary Examiner* — Edward Look
*Assistant Examiner* — Christopher R Legendre
(74) *Attorney, Agent, or Firm* — Reinhart Boerner Van Deuren P.C.

(57) ABSTRACT

Guide vane stage of a turbine engine comprising a series of fixed blades connecting an inner collar to an outer collar, characterized in that said fixed blades comprise attachment platforms with flat surfaces that co-operate with a plurality of juxtaposed flat facets, the flat facets being located on the inner face of the outer collar in order to ensure attachment with a contact of a flat/flat type between the fixed blades and the outer collar.

15 Claims, 5 Drawing Sheets

Bolted architecture

Welded architecture

GUIDE VANE ARCHITECTURE

CROSS-REFERENCE TO RELATED PATENT APPLICATIONS

This patent application claims the benefit of European Application No. 08172599.6 filed Dec. 22, 2008, the entire teachings and disclosure of which are incorporated herein by reference thereto.

FIELD OF THE INVENTION

The present invention relates to turbine engine stators. More specifically, it relates to a guide vane architecture in an axial compressor of a turbine engine.

STATE OF THE ART

Axial compressors are well known per se and they are used in several types of application. In particular, they are used in turbojets.

These low or high-pressure compressors comprise several stages of rotating blades that are separated by guide vane stages whose purpose is to realign the speed vector of the fluid coming from the previous stage before sending it to the next stage.

These guide vane stages essentially comprise fixed blades connecting an outer collar to an inner collar, both being concentric and delimiting the zone of airflow or aerodynamic flow.

There are two major types of architecture for assembling the fixed blades to the outer collar. On the one hand, there is the architecture where the platform of the blade is riveted to the outer collar on the side opposite the aerodynamic flow; such an architecture is shown in FIG. 3 of U.S. Pat. No. 6,543,995 B1. On the other hand, there is the architecture where the platform of the blade is fixed to the outer collar on the side of the aerodynamic flow. In the latter case, the platform is either attached by a system of notches, or welded or bolted as shown in FIG. 2, or even riveted. Examples of such embodiments may be seen in documents U.S. Pat. Nos. 5,584,654 A, 5,474,419 A, EP 1 936 121 A1 and EP 0 953 729 B1, respectively.

Except in the case where the blades are welded to the outer collar, the contacts between the platform of the blade and the outer collar may be of the type flat-curved, curved-curved or flat-flat, respectively.

The drawback of flat-curved or curved-curved types of assembly is that the two surfaces in contact do not fit perfectly. In the case of a flat-curved type of contact, it is easy to understand that the two surfaces do not perfectly fit together. In the case of a curved-curved type of contact, the manufacturing tolerances are such that the two surfaces do not have exactly the same radius of curve and as a result they do not perfectly match each other.

If the joint between the two surfaces around the point of attachment isn't good, premature wear known as "fretting" may be caused between the two surfaces in the event of vibration. To avoid this phenomenon, it is necessary to apply pretensioning during the attachment of the platform of the blade to the collar.

A flat-flat type of contact where the two surfaces fit each other perfectly allows to reduce the strains induced during assembly and to prevent instability of the positioning of the blade around the attachment point.

EP application 1 801 357 A1 describes a stator blade arrangement in a turbine engine comprising a ring of fixed blades mounted on an outer collar, each blade having a platform intended to be attached to the outer collar. The blade arrangement is characterised in that the outer collar comprises a plurality of individual seats for the platforms that are machined into the thickness of the collar, the shape of each seat matching that of the corresponding platform. According to a preferred embodiment, the seats are in the form of recesses with flat bottoms and the platforms are in the form of plates.

U.S. Pat. No. 6,543,995 B1 describes a guide vane where the contact between the platform of the blade and the outer collar is of the flat-flat type. Flat facets are machined on the outer collar and arranged around the circumference of the side opposite the aerodynamic flow, the platform of the blades have flat surfaces on their inner face (on the side of the blade itself). The contact between the platform of the blade and the outer collar occurs on the side that is opposite the aerodynamic flow. Such assembly architecture requires to machine a series of wide apertures in the outer collar in order to allow the blade to pass through it.

These wide apertures have the drawback of weakening the material making up the outer collar. Moreover, the guide vane architecture disclosed requires the use of an elastomer material to fill the gaps between the profile of the blade and the apertures in the outer collar. This is so in order to obtain a perfectly smooth surface on the side of the aerodynamic flow.

Aims of the Invention

The present invention aims to provide a solution that allows to overcome the drawbacks of the state of the art.

The present invention aims more particularly to provide the architecture for a blade/outer collar assembly, where the attachment strains are reduced.

The present invention also aims to provide the architecture for a blade/outer collar assembly, where the only apertures in the outer collar are those required by the attachment systems (rivets, bolts, "lockbolt", . . . ).

The present invention also aims to provide the architecture for a blade/outer collar assembly, where the platforms are arranged in such a way as to improve aerodynamic performance.

Main Characteristic Elements of the Invention

The present invention discloses a guide vane stage of a turbine engine comprising an assembly of fixed blades connecting an inner collar to an outer collar, said fixed blades comprising attachment platforms with flat surfaces that cooperate with a plurality of juxtaposed flat facets, said flat facets being located on the inner face of the outer collar so as to ensure attachment with a contact of the flat/flat type between the fixed blades and the outer collar.

According to particular embodiments of the invention, the guide vane stage comprises at least one or a suitable combination of the following features:

- The outer collar is formed by a plurality of juxtaposed flat segments.
- The platforms are arranged side by side so as to present a continuous smooth surface to the airflow.
- The outer collar is made of a composite material.
- The only apertures in the outer collar are those required by the systems for attaching the platforms of the blade to the inner face of the outer collar.
- The attachment systems comprise a bolted fastener.

The bolted fastener comprises a threaded bolt fixed to the blade, said bolt passing through the outer collar to be bolted to the outer face of the outer collar by a nut.

The bolted fastener has an L-shaped flange that is integrated to the platform of the blade and said flange is bolted to a flange for fixing the outer collars.

The attachment systems include rivets or "lockbolts".

The platforms of the blade are glued to the flat facets or flat segments of the outer collar, made of composite material.

The attachment systems are a combination of rivets, bolted fasteners and "lockbolts".

The present invention also discloses a method for manufacturing a guide vane stage of a turbine engine according to claim 4 comprising a stage of moulding by resin transfer or a stage of cocuring by resin transfer for attaching the outer collar to the fixed blades.

Figure 1:
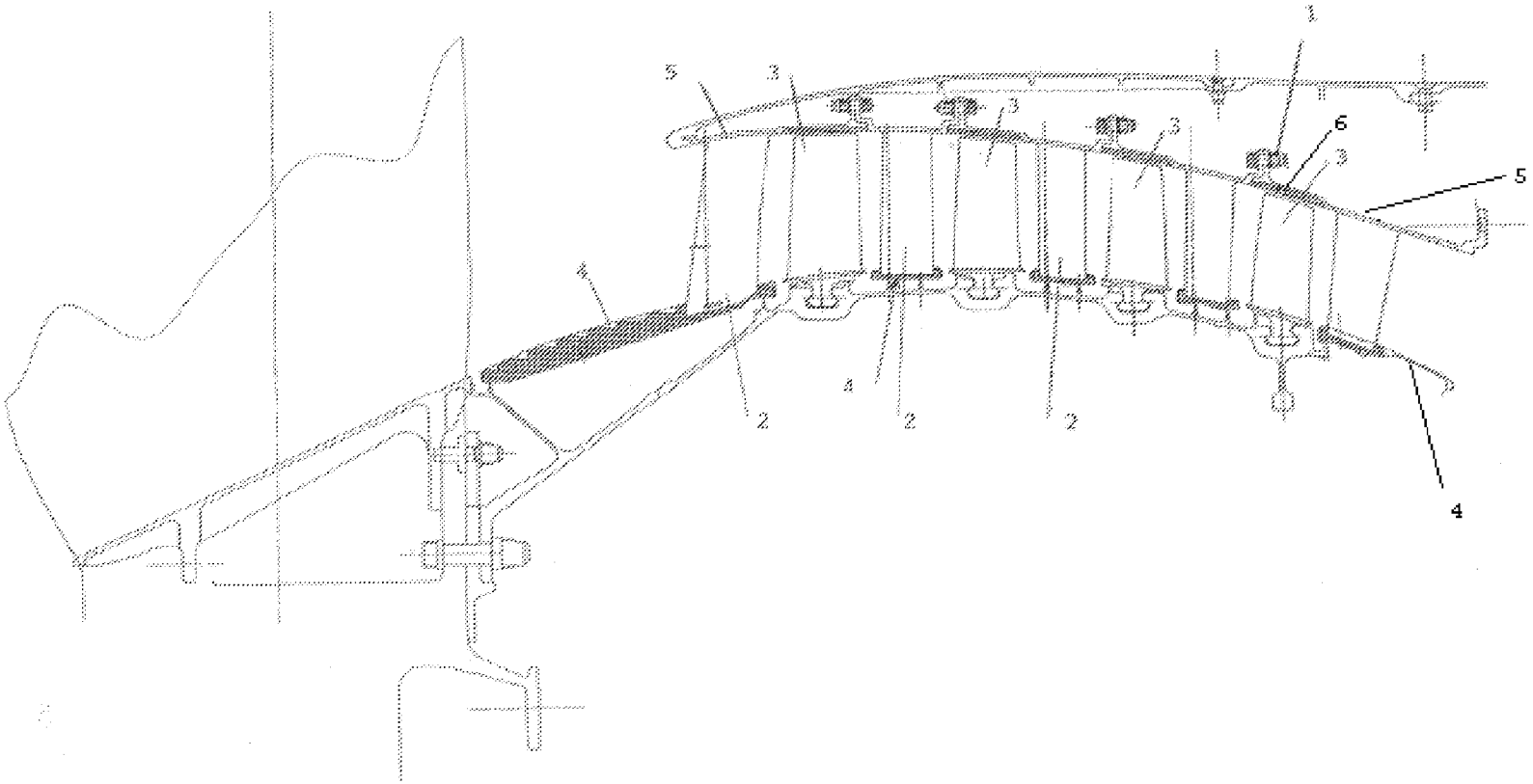
FIG. 1 shows a section of a part of a turbocompressor.
Figure 2:
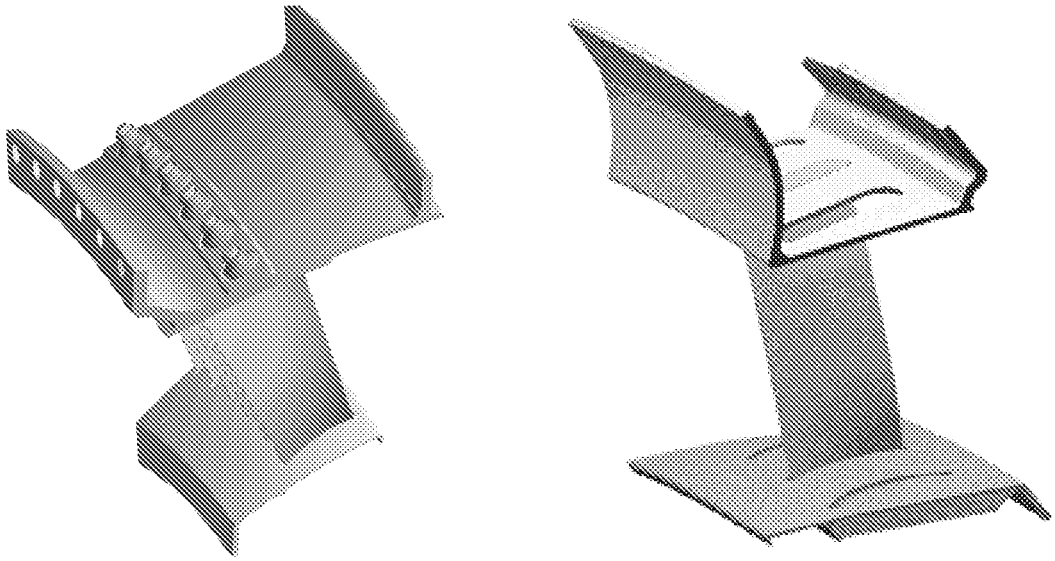
FIG. 2 shows a 3D view of two types of blade/outer collar assembly according to the state of the art.

KEY (1) Attachment flange between outer collars
(2) Fixed blades
(3) Mobile blades
(4) Inner collar
(5) Outer collar
(7) Platform
(8) Platform with integrated flange
(9) "Lockbolt"
(10) Flat segment of the outer collar
(11) Bolted fastener

DETAILED DESCRIPTION OF THE INVENTION

The present invention relates to an architecture for attaching guide vane blades to the outer collar in a turbocompressor.

FIG. 1 shows a section of a part of a turbocompressor showing the rotating blades 3 driven by the shaft of the compressor and the guide vane blades 2 attached to the inner collar 4 and outer collar 5.

In the present invention, the outer collar, instead of being a continuous curved surface, is made up of a series of flat facets located on the side of the aerodynamic flow, the flat facets being juxtaposed.

According to one embodiment of the invention, the outer collar is formed by a plurality of flat facets on the side of the aerodynamic flow and on the side opposite the aerodynamic flow. In this case, this will be referred to as an outer collar made up of a plurality of flat segments, the latter also being juxtaposed.

In the following, the inner face of the outer collar or the side of the aerodynamic flow will equally be used. The outer face of the outer collar or the side opposite the aerodynamic flow will also be equally used.

The outer collar is preferably made of a composite material and produced by a technique of resin transfer moulding (RTM).

To establish a contact of the flat-flat type between the blade and the flat facets or flat segments of the outer collar, the blades comprise a platform with a flat surface on the side opposite the blade itself.

According to the invention, the contact between the platform of the blade and the flat facets or flat segments of the outer collar is only made on the side of the aerodynamic flow.

Figure 3:
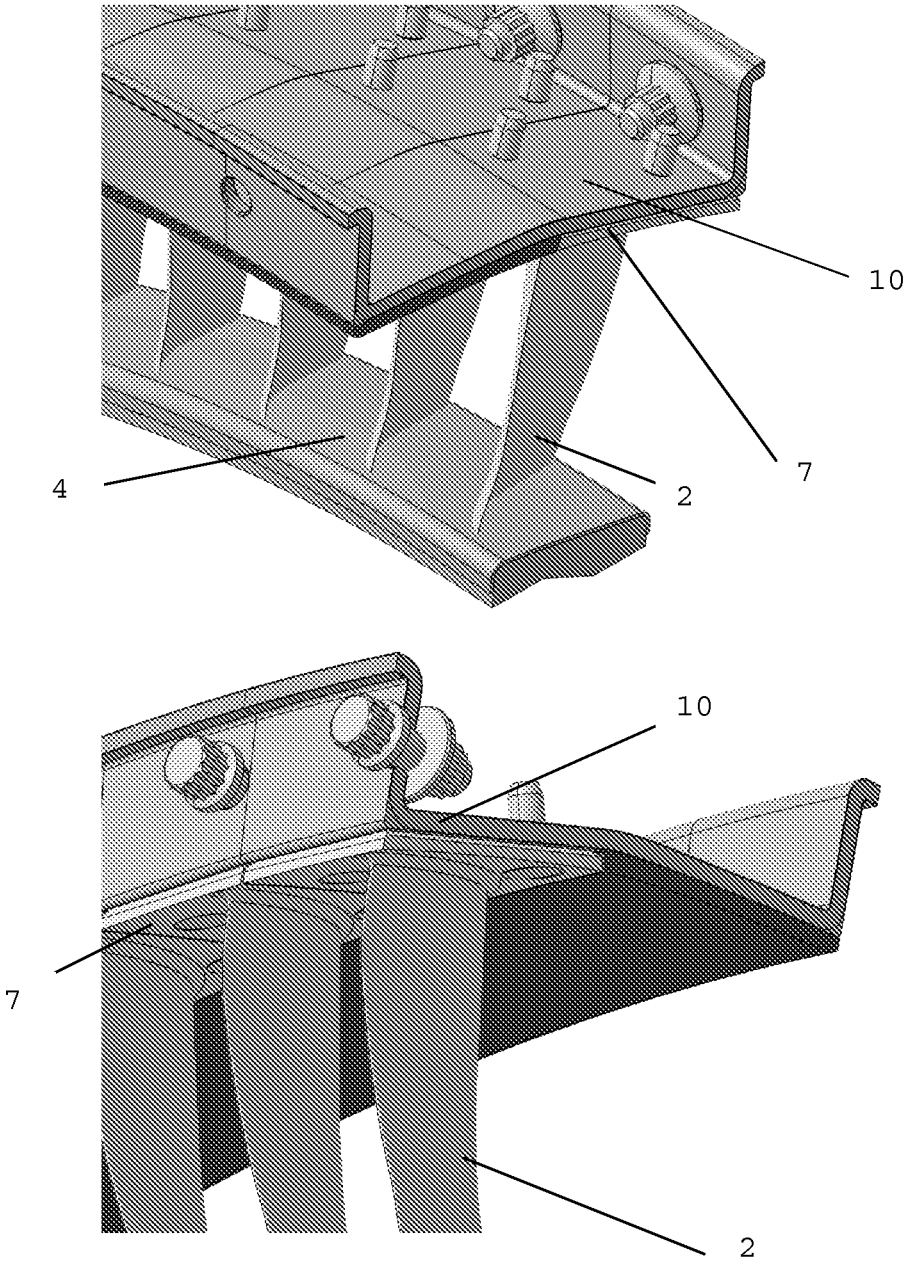
FIG. 3 shows two 3D views of a contact between a platform of the blade and an outer collar according to the invention.

FIG. 3 shows the contact of a flat-flat type between the platform 7 of the blade 2 and the flat segments 10 of the outer collar on the inner face of the outer collar.

The platforms 7 are arranged side by side so as to present a continuous smooth surface to the airflow, which allows to improve aerodynamic performance compared with a welded configuration where the welded joint protrudes into the flow.

The only apertures required in the outer collar are those of the systems for attaching the platform of the blade to the inner surface of the outer collar.

Figure 4:
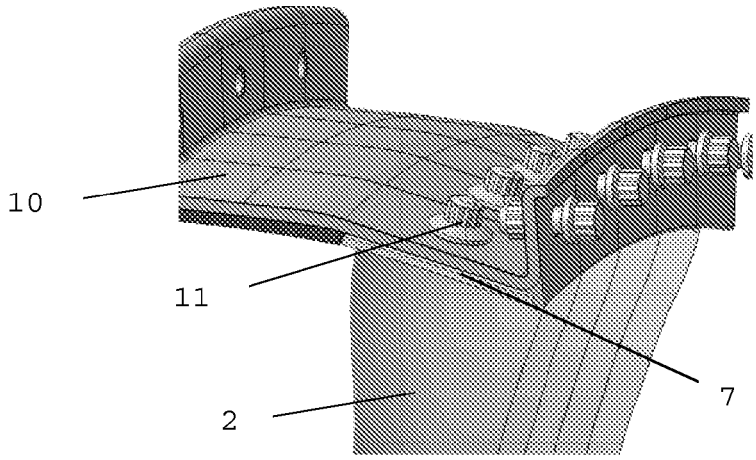
FIG. 4 shows a 3D view of the bolting of the platform of the blade to the outer collar according to the invention.
Figure 5:
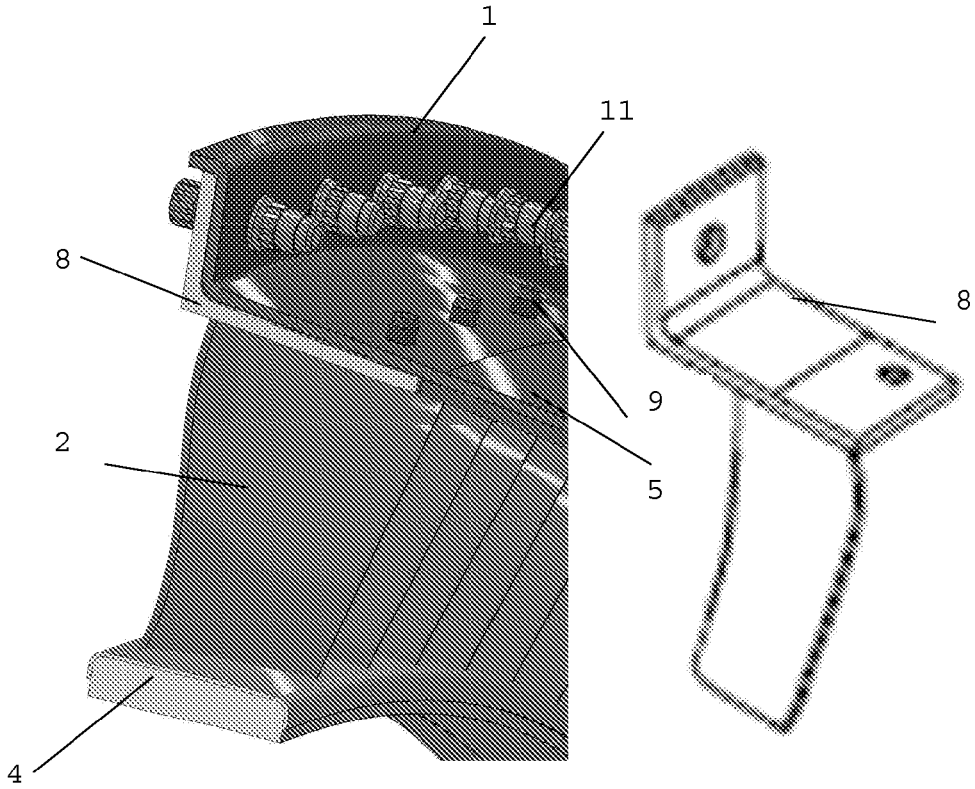
FIG. 5 shows a 3D view of the bolting of the platform of the blade to the outer collar according to another configuration of the invention.

According to one particular embodiment of the invention, the attachment system is a bolted fastener 11 (see FIGS. 4 and 5). The bolting is achieved at the level of the flat facets or flat segments of the outer collar or at the level of the flanges provided for attaching the collars to each other.

FIG. 4 shows the first configuration. A threaded bolt fixed to the blade passes through the collar and is bolted to the outer collar by a nut on the side opposite the aerodynamic flow.

According to the second configuration of FIG. 5, an L-shaped flange 8 is fixed to the platform of the blade and is bolted by connection to the attachment flange 1 of the outer collars 5 (see also FIG. 1). Moreover, a "lockbolt" 9 also maintains the platform of the blade in contact with the flat facet or segment of the outer collar.

Figure 6:
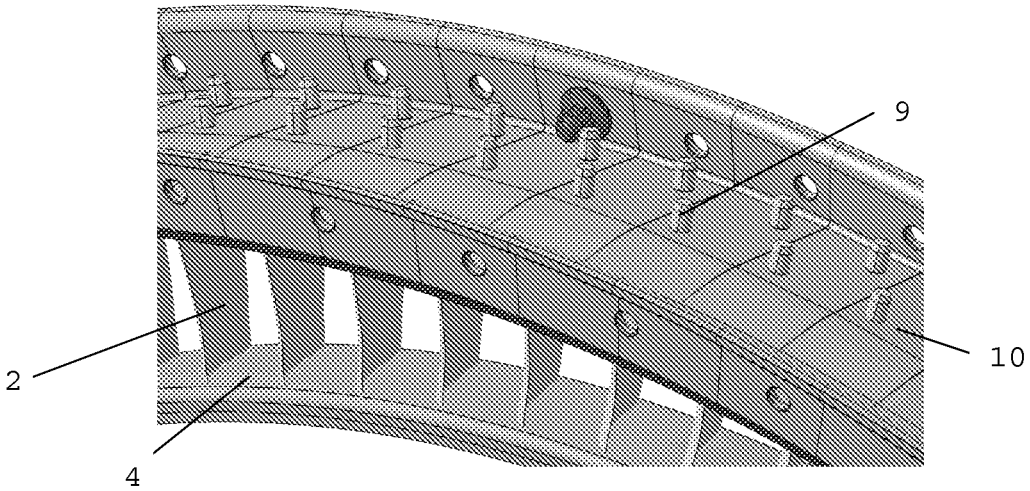
FIG. 6 shows a 3D view of the platforms of the blade attached to the outer collar by means of "lockbolts" according to the invention.

According to another embodiment shown in FIG. 6, the platforms of the blade are attached to the flat facets or segments of the outer collar only by means of "lockbolts". In the example shown, each platform is attached to the flat segment 10 of the outer collar by means of two "lockbolts" 9.

As a variant, the platforms are attached by means of rivets (not shown).

According to other embodiments, the blades may be attached by means of attachment systems that combine bolted fasteners, rivets and "lockbolts".

The invention has the advantage that only one or two attachment elements, namely the bolted fastener, the rivet or the "lockbolt", are required for attaching a platform of the blade to a flat facet or flat segment of the outer collar.

According to another embodiment of the invention, the platforms are glued to the outer collar or alternatively the platform of the blade is fitted to the outer collar by "cocuring". The latter attachment technique is based on the RTM technique and consists in the simultaneous production of the composite parts (blade and outer collar) and the joint between the two parts.

Advantages of the Attachment Architecture According to the Invention

The flat-flat contact allows to reduce the strains of assembly.

Reducing the static strains during assembly allows to use composite materials for the outer collar and light alloys or composites for the blades and, as a result, reduces weight.

In the course of the manufacture of an outer collar made of composite material by the technique of resin transfer moulding (RTM), the flat facets or flat segments are directly moulded to their finished dimensions, which greatly reduces the machining operations compared with the production processes of the prior art U.S. Pat. No. 6,543,995 B1, where the flat facets or flat segments are machined from a part that is roughly made by turning and from which the openings and holes have to be drilled.

The junction lines between the platforms of the blade are not parallel to the speed vector of the airflow, the latter being at an angle relative to the junction lines. This has the advantage of restricting the directions of leaks compared with a configuration where the speed vector of the airflow is parallel to the junction lines, as is the case in the prior art U.S. Pat. No. 6,543,995 B1, and therefore of minimising aerodynamic turbulence.

The presence of adjacent platforms on the side of the aerodynamic flow allows to reduce the contact surface between the airflow and the outer collar, which leads to a reduction in the wear of the latter.

Similarly, the presence of adjacent platforms ensures a good seal without resorting to the use of elastomer material.

The only apertures required in the outer collar are those for the attachment holes. In the case of attachment by gluing or cocuring, the outer collar is free of any apertures.

Suppressing the wide apertures in the outer collar has the advantage of not reducing the structural strength of the collar. More particularly, this is an advantage for collars made of long-fibre composite where the apertures in the collar cut the fibres and hence considerably reduce the mechanical strength of the material.

In the event of the loss of a fan blade (Fan Blade Out), suppressing the large apertures and the fact that the platforms are attached to the inner face of the outer collar allows to confine the crashing of the blades within the low-pressure compressor.

Thanks to this system of blade/outer collar interface, the fitting of the blades is perfectly interchangeable, i.e. the platform and the attachment system may be identical whilst having different profiles or material for the blades.

Since the attachment system is mechanical, this solution is advantageous to the removal and reattachment of the blades during repair, compared with a welded configuration.

The invention claimed is:

1. Guide vane stage of a turbine engine comprising a series of fixed blades (2) connecting an inner collar (4) to an outer collar (5), characterised in that said fixed blades (2) comprise attachment platforms (7) with flat surfaces that co-operate with a plurality of juxtaposed flat facets, said flat facets being located on the inner face of the outer collar (5) in order to ensure attachment with a contact of a flat/flat type between the fixed blades (2) and the outer collar (5), wherein said platforms (7) are positioned side by side so as to present a continuous smooth surface to the airflow.

2. Guide vane stage of a turbine engine according to claim 1, characterised in that the outer collar (5) is formed by a plurality of juxtaposed flat segments (10).

3. Guide vane stage of a turbine engine according to claim 1, characterised in that the outer collar (5) is made of a composite material.

4. Guide vane stage of a turbine engine according to claim 3, characterised in that the platforms (7) of the blades (2) are glued to the flat facets or flat segments (10) of the outer collar (5) made of a composite material.

5. Method for manufacturing a guide vane stage of a turbine engine according to claim 3 comprising a step of resin transfer moulding to produce the outer collar.

6. Method for manufacturing a guide vane stage of a turbine engine according to claim 3 comprising a cocuring step by resin transfer for attaching the outer collar to the fixed blades.

7. Guide vane stage of a turbine engine according to claim 1, characterised in that a plurality of apertures in the outer collar (5) are only those required by attachment systems for the platforms (7) of the blades (2) on the inner face of the outer collar (5).

8. Guide vane stage of a turbine engine according to claim 7, characterised in that the attachment systems comprise a bolted fastener (11).

9. Guide vane stage of a turbine engine according to claim 8, characterised in that the bolted fastener (11) has a threaded bolt fixed to the blade (2), said bolt passing through the outer collar (5) so as to be bolted to the outer face of the outer collar by a nut.

10. Guide vane stage of a turbine engine according to claim 9, characterised in that the attachment systems are a combination of rivets, bolted fasteners and "lockbolts" (9).

11. Guide vane stage of a turbine engine according to claim 8, characterised in that the bolted fastener secures an L-shaped flange (8) integrated into the platform (7) of the blade (2) and in that said flange (8) is bolted to an attachment flange (1) of the outer collars (5).

12. Guide vane stage of a turbine engine according to claim 7, characterised in that the attachment systems comprise rivets or "lockbolts" (9).

13. The Guide vane stage of claim 1, wherein the attachment platforms are entirely disposed radially inboard of the collar.

14. The Guide vane stage of claim 1, wherein terminating ends of the fixed blades terminate radially inward of the platform and reside radially inward of the outer collar.

15. The Guide vane stage of claim 1, wherein flat facets of the outer collar face the inner collar.

* * * * *